United States Patent [19]

Miller, III

[11] 4,011,408

[45] Mar. 8, 1977

[54] AUDIO TRANSMISSION PROTECTION APPARATUS

[75] Inventor: Chauncey S. Miller, III, Rancho Palos Verdes, Calif.

[73] Assignee: TRW Inc., Redondo Beach, Calif.

[22] Filed: Dec. 17, 1975

[21] Appl. No.: 641,471

[52] U.S. Cl. ..... 179/1.5 R; 178/22

[51] Int. Cl.[2] ..... H04K 1/02

[58] Field of Search ..... 179/1.5 R, 1 F; 178/22; 331/78

[56] References Cited

UNITED STATES PATENTS

| | | | |
|---|---|---|---|
| 3,370,126 | 2/1968 | Scidmore | 179/1.5 R |
| 3,515,805 | 6/1970 | Fracassi et al. | 178/22 |
| 3,784,743 | 1/1974 | Schroeder | 178/22 |
| 3,879,578 | 4/1975 | Wildi | 179/1.5 R |

*Primary Examiner*—Howard A. Birmiel
*Attorney, Agent, or Firm*—John J. Connors; Edwin A. Oser; Donald R. Nyhagen

[57] ABSTRACT

In delay module means, an input signal is divided into a number of subsignals, each separated from the others by a selected time delay. In a primary module the subsignals are selectively weighted and combined with the input signal. In the inverse module, the signal is similarly differentially delayed and weighted, and subtracted from the input by feedback loop means. Audio signal scrambling is accomplished by passing the signal through one or more primary and/or inverse modules in series; descrambling is accomplished by passing the scrambled signal through a complementary series of modules. Frequency translation and/or inversion is also applied for applications requiring increased security.

14 Claims, 15 Drawing Figures

AUDIO TRANSMISSION PROTECTION APPARATUS

BACKGROUND OF THE INVENTION

1. Field of Invention

This invention relates to the scrambling of analog (particularly voice) signals for secure transmission to authorized receivers.

2. Description of Prior Art

In recent years, a good deal of research has been directed toward providing means whereby voice and other audio signals may be transmitted to remote users in such manner that unauthorized listeners are unable to decipher the message, if they are able to receive it at all. The military, in particular, employ highly sophisticated signal transmission methods utilizing statistical and other complex techniques. Apparatus embodying these techniques are ordinarily very expensive. However, the need for complete security in the applications in which they are utilized, easily justifies their cost.

There are, however, other users of communication apparatus, such as police agencies and the financial community, which also have a need for secure transmission of messages. In most cases, however, these users do not have a need for such highly sophisticated and expensive apparatus, since the messages they ordinarily wish to transmit are not of the same order of strategic importance, and their "adversaries" are generally less sophisticated. The systems presently available to such users provide only modest security and are too expensive to enable their widespread use, for example, in police squad cars.

SUMMARY OF INVENTION

Accordingly, it is an object of the present invention to provide transmission scrambler and receiver descrambler apparatus for scrambled voice or other audio signals, which will provide a relatively high level of security at a relatively low cost.

The principle underlying the present invention involves the use of deliberately induced multi-path interference to scramble the audio message. Primary (feed-forward) and inverse (feed-back) modules are utilized. The scrambler and descrambler may each employ a single module — one the complement of the other. However, the scrambler may incorporate any number of either type of module or a mixture of them in series; the descrambler must then incorporate a complementary series, i.e., a corresponding inverse module in the same relative position of the series as a primary module in the scrambler, and vice versa.

Both types of modules incorporate delay means which, during serial receipt of an input signal, create a selected number of subsignals, each identical to the input signal but separated in time from that signal and the other subsignals by a selected increment. Depending on the embodiment, the increment may be identical between all "adjacent" subsignals; different but fixed; or variable, according to a selected scheme.

In either type of module, the subsignals may each be selectively weighted. The weighing factor(s) should be less than unity, but may otherwise be identical for all or some subsignals; fixed but different; or variable, according to a selected scheme.

In a primary module, the final subsignals are combined in some way with the primary signal to create the module output. In the complementary (inverse) module, the input signal is passed through delaying and weighting circuitry which is essentially identical to that employed in the primary module, but here, the resultant is subtracted from the input thereto, in the manner of a feedback loop.

The various embodiments of the present invention differ from one another in the manner in which the individual modules are employed, in how the delay and weighing functions are performed, in whether and in what manner the individual weights and delays are selected and implemented, and in whether and in what manner additional complexity, such as frequency manipulation, is introduced for a greater level of security in the message transmission.

DETAILED DESCRIPTION OF THE PREFERRED EMBODIMENT

A. Basic Delay Modules

There are two essential types of delay modules according to this invention — a primary (feed-forward) type and its inverse (feed-back).

For the purposes of this section A, it will be assumed that the scrambler of the present invention comprises a single primary module or primary function of a combination module, while the descrambler comprises a single complementary (inverse) module or function. It will later be shown that, because each of the individual scrambler/descrambler operations can be assumed linear, any number of selectively complex primary and/or inverse modules may be incorporated in series in the scrambler, provided a complementary series is incorporated in the descrambler. In particular, the scrambler may comprise an inverse module or function, and the descrambler may comprise a primary module or function.

Figure 1A:
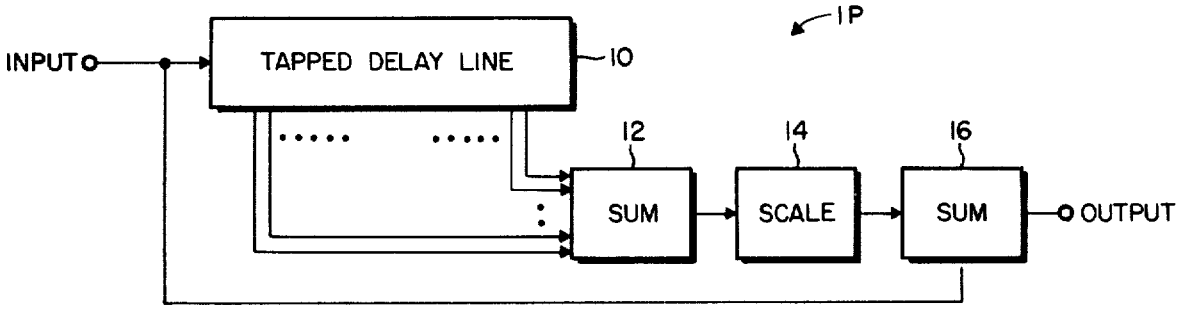
FIG. 1A is a logic block diagram of a primary module according to an embodiment of the present invention.

FIG. 1A is a logic block diagram of a basic embodiment of the transmission scrambler of the present invention, comprising a single primary module 1P. The input thereto is derived from the message which is to be transmitted. If the message is a voice communication, the input would most likely be ultimately derived from a microphone, tape recorder or similar apparatus and suitably amplified and conditioned in a manner well-known in the audio transmission art. In digital embodiments, the processed signal would, of course, initially be analog-to-digital converted at a selected sample rate, which would determine, in a well-known manner, the cycle time of the other elements of the apparatus.

The input is passed serially into the tapped delay line 10, which has a number of outputs by which the serially introduced and delayed signal can be tapped off in parallel, to generate a number (equal to the number of taps) of subsignals, each temporally separated from its neighbors, according to the differential delay between successive taps.

Analog tapped delay lines are well-known in the art and readily available off-the-shelf. Digital devices to perform this function, such as charge-coupled devices (CCD) or other digital shift registers are likewise well-known and readily available.

The subsignals are combined by the summer 12, e.g., a summing junction (analog), or (digital) adder/accumulator, which outputs the instantaneous combination of signals to a scaling device 14. The purpose of the scaling device is to alter the instantaneous amplitude of the combination signal, to further scramble the ultimate transmission and also to insure system stability. I have found that the latter result can be achieved if the scale factor applied by the scaling device is less than unity.

The scaling device 14 is actually a multiplier and can be embodied, in analog embodiments of the present invention, as an operational amplifier. In digital embodiments, it is most convenient to utilize a shift register, wherein the (normally binary or BCD) input thereto is inputted in parallel, shifted to the "right" by one or more bits (i.e., divided by an integral power of "2") and outputted in parallel. The Signetics Corporation eight-bit position shifter (part number N8243N) is typical of many devices available to accomplish this. Such scaling will satisfy the aforementioned preferred constraint of a less-than-unity scale factor.

The instantaneous output from the scaling device 14 is summed with the instantaneous input to the scrambler by means of a second summer 16, which is essentially identical to the first summer 12. The output of the second summer is suitably processed for transmission in any conventional manner.

At the remote receiving station, the scrambled message is received and suitably amplified and otherwise processed in a conventional manner for input to the descrambler.

Figure 1B:
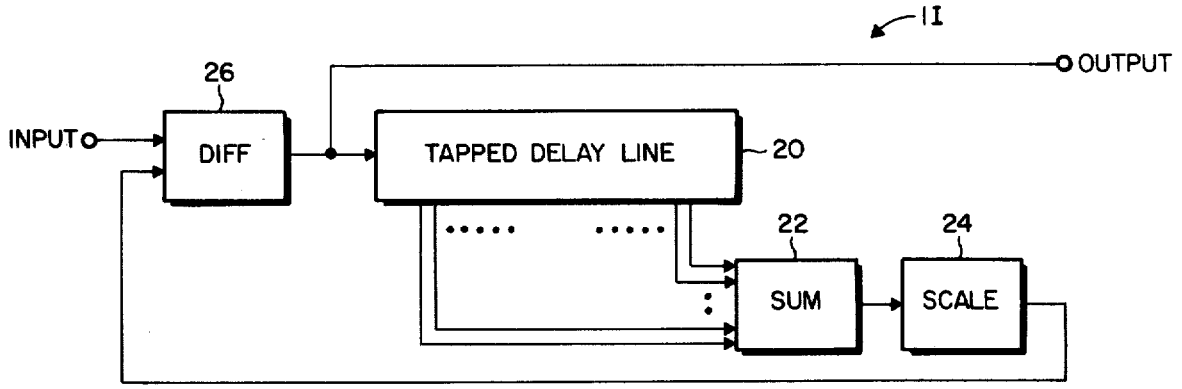
FIG. 1B is a logic block diagram of an inverse module according to an embodiment of the present invention.

As shown in FIG. 1B, the corresponding descrambler comprises an inverse module 1I, which essentially comprises a feedback loop, the first element of which, and the one which receives the processed input, is a negative summer 26. This may be embodied as an inverter and summing junction in series, for an analog module, or as a digital negative adder/accumulator.

The remaining elements are, in series, a delay line 20 of the same type and having the same number of taps (with the same time delay between them) as the delay line 10 of the complementary primary module 1P; a summer 22, which is identical to the summer 12 in the primary module, to receive the parallel inputs from the descrambler delay line 20; and a scaling device 24, which is identical to the scaling device 14 in the transmission apparatus and which applies the same scale factor. The output from the scaling device is the second input to the negative summer 26.

The inverse module output is taken from a point between the negative summer 26 and the input to the delay line 20. The output is suitably and conventionally processed for reproduction, for example, by means of a loudspeaker.

What occurs in the transmission/scrambler and corresponding receiver/descrambler will now be described by means of a simple example, in which we will assume that the original signal to be scrambled and ultimately descrambled consists of a single pulse, and that there are four taps from the delay line 20.

At $t_o$, the pulse arrives at the input to the tapped delay line 10 and also at the summer 16 for transmission. Assuming zero transmission time, it also appears at the negative summer 26 in the receiver and is outputted from the descrambler, since, at $t_o$, there is nothing in the descrambler delay line 20.

At $t_1$, the pulse reaches the left-most tap on the transmitting delay line 10, passes through the summer 12, has a scale factor applied to it by the scaling device 14, and passes to the second summer 16. Since the original pulse has already been transmitted, the signal input is zero, and the summer simply passes the scaled pulse for transmission.

Also, at time $t_1$, the scaled pulse appears at the receiver and is applied to the input of the negative summer 26. However, the other input is the original pulse, which, at $t_1$, is tapped off the left-most tap of the scrambler delay line 20, summed (with nothing) and scaled by the same scale factor. Consequently, the value of the pulse fed back to the negative summer 26 is the same as the input, so that the two cancel, yielding a null output.

It can easily be seen that at $t_2$, $t_3$ and $t_4$, the same occurs i.e., there is no output from the receiver descrambler.

Furthermore, in the real case of non-zero transmission time, the result is the same. This is because the elapsed time for transmission of the original pulse to the receiver is identical to the elapsed time for transmission of the $t_1$ pulse. Thus, by the time the received pulse is tapped off of the left-most tap of the receiver/descrambler delay line 20, and fed through the summer 22 and scaling device 24, into the negative summer 26, the scaled down $t_1$ pulse will have just been received at the negative summer 26 for subtraction. The same occurs, of course, with the $t_2$, $t_3$ and $t_4$ pulses.

Since the operation of the present invention is linear, it can easily be shown by superposition that with more complex signals, the result is identical, i.e., by utilizing identical delay lines 10, 20 and an identical scale factor, the descrambler will, in fact, ouput the original message in descrambled form.

Since the primary and inverse modules are so nearly identical, and because of the linearity of their functions, it is possible to combine their functions in a single apparatus.

Figure 1C:
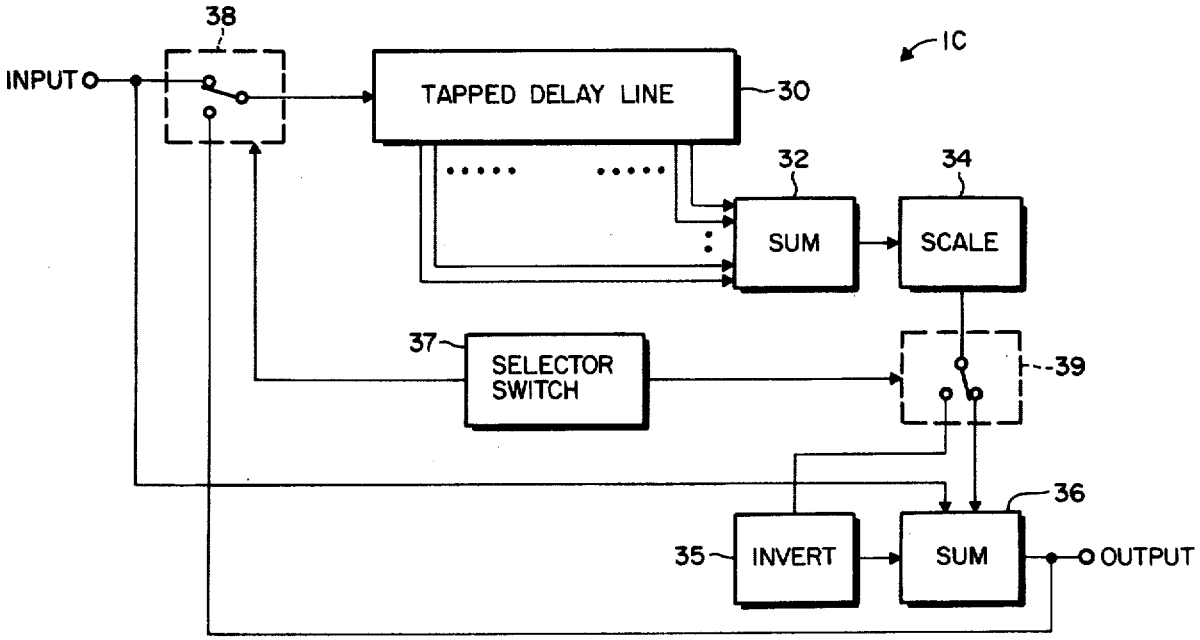
FIG. 1C is a logic block diagram of an apparatus performing the primary and inverse operations of the apparatus shown, respectively, in FIGS. 1A and 1B.

FIG. 1C is a logic block diagram of just such a combination module 1C. Here, a single tapped delay line 30, a summer 32 and a scaling device 34, each similar to corresponding elements in the foregoing devices, are utilized. However, because, in our present assumption, transmission requires positive summing and descrambling requires differencing (negative summing), an inverter 35 is incorporated to change the sign of the signal from the scaling device to the summer, during the RECEIVE (inverse) mode. A switch 39 insures that the inverter is bypassed during the TRANSMIT (primary ) mode. An initial switch 38 and this latter switch 39 are operated in unison by means of a selector switch 37, which may be the same thumb-operated switch used by the operator of the apparatus to otherwise select between TRANSMIT and RECEIVE modes in the transmitter/receiver in which the present apparatus can be incorporated.

The scrambler/descrambler apparatus shown in FIG. 1C is in the primary, TRANSMIT mode, since the switches 38, 39 are in their upper positions, and, thus, the inverter 35 is bypassed. The alternate position of the switches would place the apparatus in the inverse, RECEIVE mode.

Figure 2A:
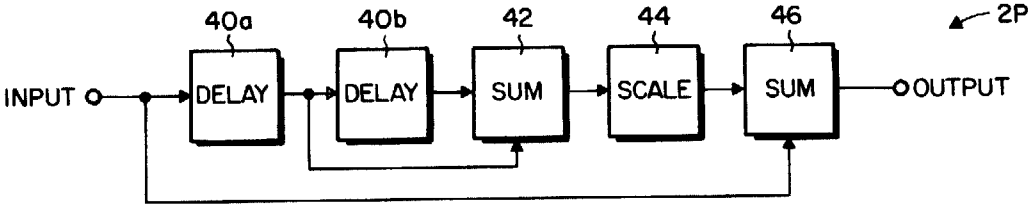
FIG. 2A is a logic block diagram of a primary module according to another embodiment of the present invention.

FIG. 2A shows an alternative embodiment of a primary module 2P. Here, the module incorporates a pair of second-order sections (i.e., delay units), instead of a tapped delay line. Each element of this embodiment may be embodied essentially as in the aforementioned embodiment.

Here, the input is fed into a first delay unit 40, whose output is passed into a second delay unit 40 and also summed with the output from the second unit, by means of a summer 42. The output from the summer is scaled (again, by a factor less than unity) by the scaling device 44, and the resultant is summed together with the original input signal, by means of a second summer 46, to provide the output.

In the complementary inverse module 2I, which constitutes the descrambler, the input scrambled message is first fed into the negative summer 56. The output of the negative summer is the module output and also the input to the first delay element 50A of the module. The output of the first delay element 50A is summed with the output of the second delay element 50B by means of the summer 52. The output of the latter is scaled by means of a scaling device 54, whose output is subtracted from the input to the first module by means of a negative summer 56.

Figure 2B:
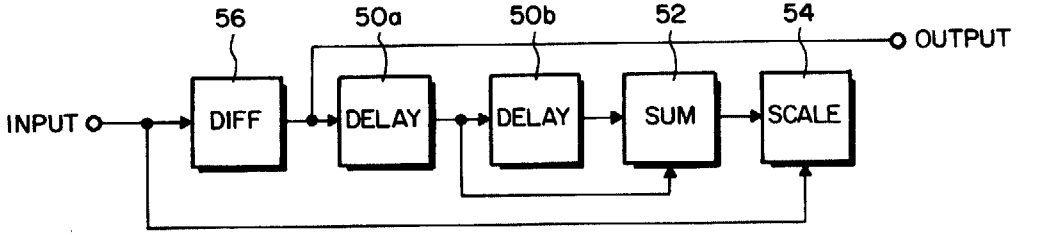
FIG. 2B is a logic block diagram of an inverse module complementary to the primary module shown in FIG. 2A.
Figure 2C:
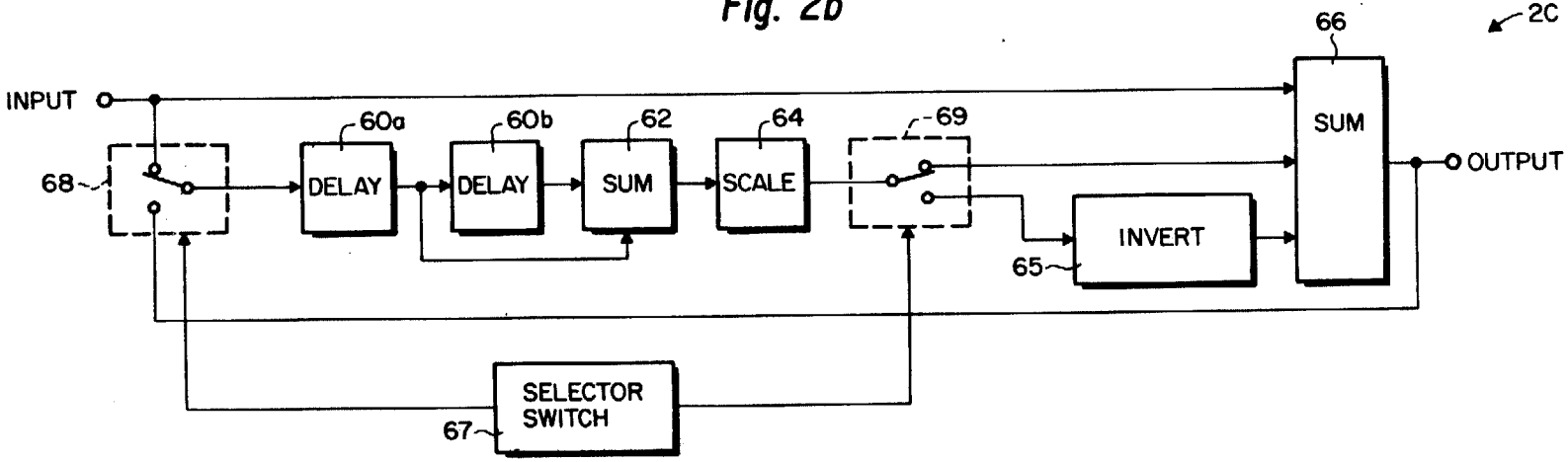
FIG. 2C is a logic block diagram of an apparatus performing the primary and inverse operations of the apparatus shown, respectively, in FIGS. 2A and 2B.

FIG. 2C shows a module 2C, similar to those shown in FIGS. 2A and 2B, in which the primary and inverse functions can both be preformed. Here, the particular mode is selected by a selector switch 67, which operates, in unison, switches 68 and 69.

It must again be noted that the foregoing assumption that the scrambler function be performed by a primary (feed-forward) module or function was merely made for convenience in discussion. Because of linearity, there is no reason why an inverse (feedback) module or function cannot be utilized for scrambling, with a complementary primary module or function utilized for descrambling.

B. Complex Delay Modules

Figure 3:
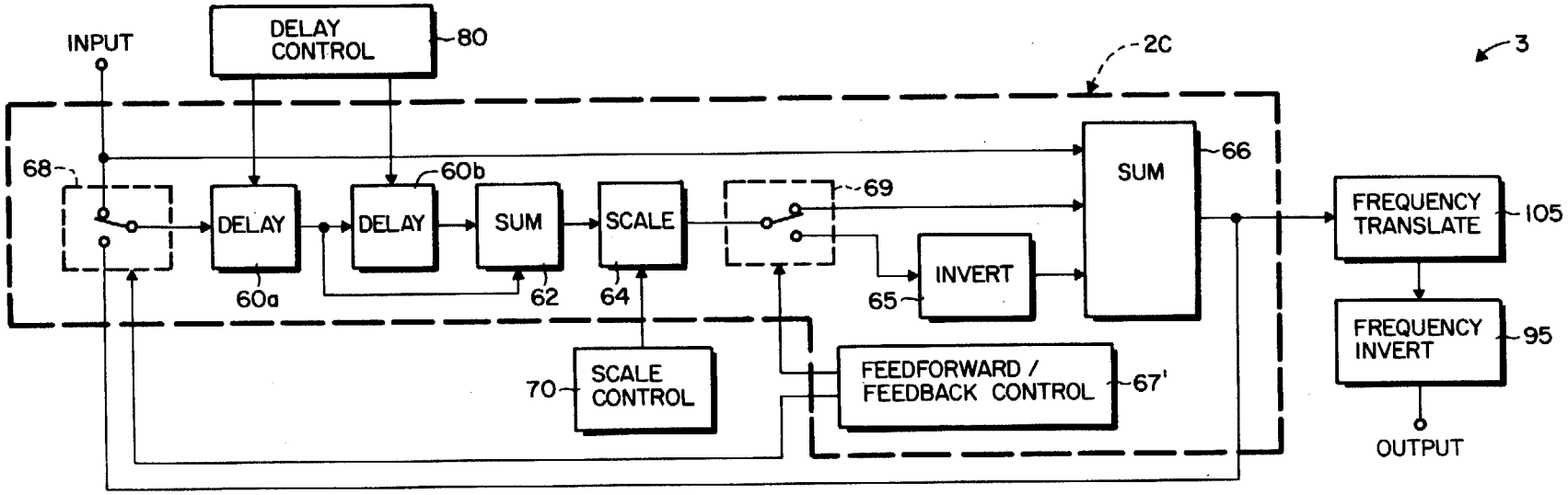
FIG. 3 is a logic block diagram of a more complex delay module incorporating feed-forward/feed-back control, delay factor control, scale factor control, frequency translation and frequency inversion.

FIG. 3 is a logic block diagram of a delay module which is far more complex than those hereinabove described. The corresponding elements of this delay module 3 are identical to those of the simpler combination delay module 2C, except that the present module incorporates, in addition, a scale control apparatus 70, delay control apparatus 80, frequency inversion apparatus 95 and frequency translation apparatus 105. Each of these four apparatus will be described in more detail below.

It should be noted that these four apparatus can likewise be added to any of the other basic delay modules hereinabove described. For example, the delay control 80 could govern the operation of the tapped delay line 10 in module 1P, while the scaling control apparatus 70 could govern the operation of the scaling device 14 and the frequency inversion and/or frequency translation apparatus, 95 and 105, respectively, could be placed at the output of the summing device 16. Of course, the modified complimentary module (in this case, module II) would have to incorporate corresponding additions.

Furthermore, the complex delay module 3 need not necessarily incorporate all four of these additional apparatus. The particular areas utilized are dictated by the transfer function complexity requirements of the particular application. In particular, either the frequency inversion apparatus 95 or the frequency translation apparatus 105, or both of them, can be eliminated, and if both are present, their relative positions can be interchanged, because of the linearity of their functions.

C. Scale Factor Control Apparatus

Figure 4:
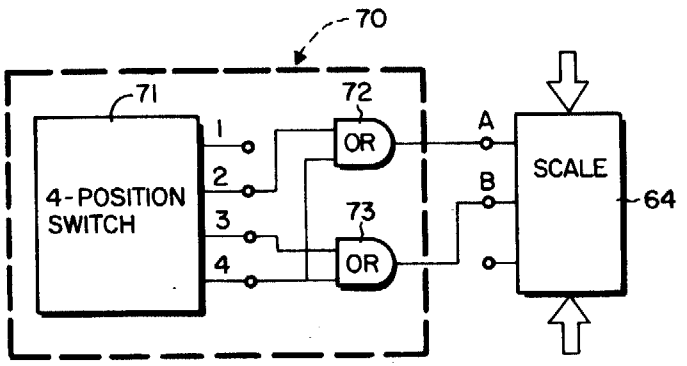
FIG. 4 is a logic block diagram of digital scale factor control means according to an embodiment of the present invention.

FIG. 4 shows a means by which the scale factor applied to the scaling device 64 of delay module 3 (or any other delay module) can be varied. In the embodiment shown in this figure, a four position switch 71 is utilized to cause a scale factor of 1, ½, ¼ or ⅛ to be selectively applied. This is accomplished as follows:

The four position switch 71 outputs a signal on a particular one of the output lines, depending on the position selected. By simple logic, the first or-gate 72 and second or-gate 73 translate the switch position into a signal to the appropriate input "A" or "B" of the scaling device 64. Position "1" on the switch will generate no input to the scaling device; position "2" will generate an input to position A; position "3" will generate an input to position B; and position "4" will generate an input to positions A and B.

The three inputs to the scaling device actually represent a binary input to its control function. An input to position A represents "two"; an input to position B represents "three" and an input to positions A and B together represents "four". The number thus represented in a binary fashion is the number of bits by which the instantaneous binary value in the scaling device will be shifted to the right, i.e., this is the integral factor of 2 by which the number in the scaling device will be divided.

The three bit control scaling devices are available off-th-shelf. For example, the aforementioned Signetics Corporation part number N8243N can be utilized for this purpose.

Thus, by selecting one of the four positions in the four position switch, the operator can cause the scaling device 64 to implement any of four scaling factors.

Figure 5:
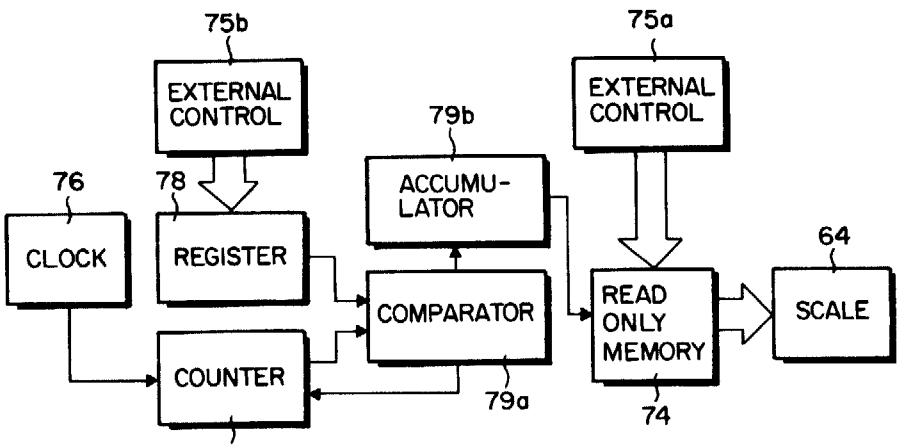
FIG. 5 is a logic block diagram of digital scale factor control means according to another embodiment of the present invention.

FIG. 5 shows means whereby greater flexibility in scaling factor manipulation can be realized.

The scaling device 64 employed in this embodiment can be any digital scaling device which accepts a control input, in accordance with which the particular scale factor is implemented with respect to the incoming data. The aforementioned three-bit control device is adequate for many digital applications.

In this embodiment, a clock 76 (which may be the same clock which determines the cycle time of the other elements in digital embodiments) is frequency divided to circulate a read only memory 74. The frequency division means comprises a counter 77, which receives the clock impulses, and a register 78, whose instantaneous values are compared by means of a comparator 79. Every $n^{th}$ clock pulse, where $n$ is the number stored in the register, the comparator outputs a pulse to the read only memory and resets the counter. An external control device 75B, which may be any sort of conventional input means, is utilized to input the desired frequency division factor into the register, normally by introducing a binary number in parallel.

Thus, every $n^{th}$ clock pulse adds to the read only memory address and causes the next scale factor in the succession of scale factors contained in the read only memory.

Another external control device 75A is provided to permit the operator to selectively address the read only memory 74, causing a discontinuous "jump" in the sequence of scaling factors outputted by the latter. Thus, the external control 75A permits an initial setting of the read only memory 74, while the external control 75B determines the frequency division factor, which ultimately determines the rate at which the read only memory is cycled to implement a succession of scale factors in the scaling device 64.

In analog embodiments of the present invention, a variable scale factor may be implemented quite simply by means of a conventional resistance voltage divider network whose division factor is determined by which of a plurality of switches are instantaneously closed in response to a digital command. This is shown schematically in FIG. 6, which represents a portion of an embodiment of the delay module shown in FIG. 2. Here, the signal from the summing device 62 is passed into the divider network incorporating series resistances $R_1$, $R_2$. . . $R_n$. Taps are taken between each adjacent pair of resistances, and each of the tapped lines passes through a switch $S_1$, $S_2$. . . $S_n$. These switches are opened or closed in accordance with an individual digital command, which determines the actual voltage division. The output from the scaling device 64' passes to the feed-forward/feed-back switch 69 for further processing in a manner hereinabove described.

The digital command is a binary number, each bit of which is addressed to and operates a particular one of the switches $S_1$, $S_2$. . . $S_n$. The command may be generated by any conventional digital command device 70', in particular, by a manually operated selector switch by which the operator determines the division voltage (scale factor) he wishes to implement. Such devices are entirely conventional and need not be described in detail.

Figure 6:
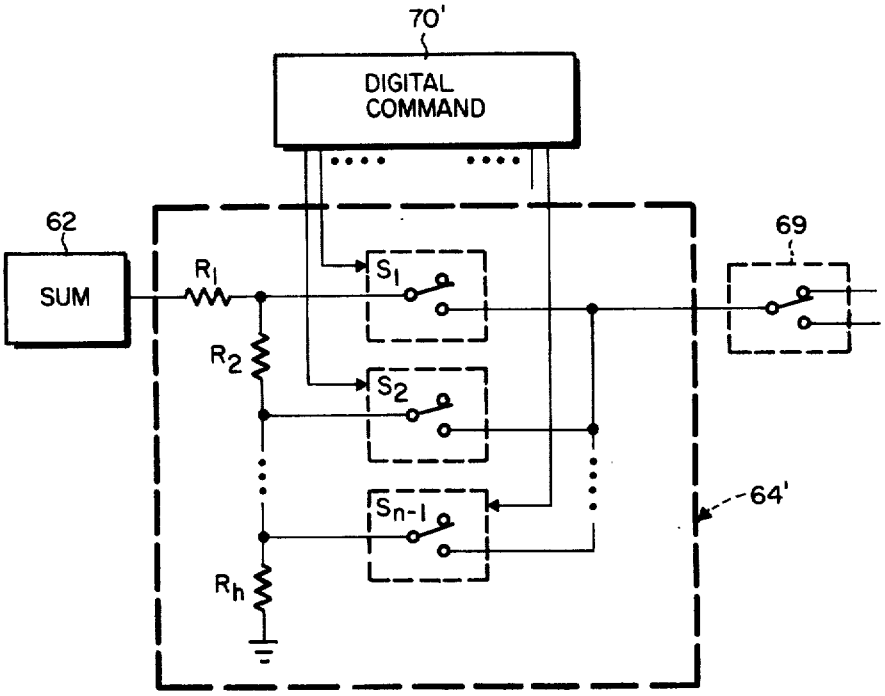
FIG. 6 is a logic block diagram of an analog scale factor control means.

Additional flexibility may be introduced by the fact that neither the read only memory 74, shown in FIG. 5, nor the analog scaling device 64', shown in FIG. 6, need be permanently incorporated into their respective apparatus. Either can constitute a plug-in module, which can be replaced selectively by another interchangeable module having different scale factor capability. Thus, if an adversary presupposed the use of a particular read only memory in a digital device, it would be exceedingly difficult for him to decipher a scrambled message if a different read only memory were substituted, since this would mean that a wholly different sequence of scaling factors would be implemented. Such plug-in modules can be appropriately coded, for ease in command to the operator(s).

In similar fashion, the external control 75A and/or the other external control 75B, shown in FIG. 5, or the digital command means 70', shown in FIG. 6, can likewise be embodied in coded plug-in modules for even greater flexibility.

D. Variable Delay Means

Figure 7:
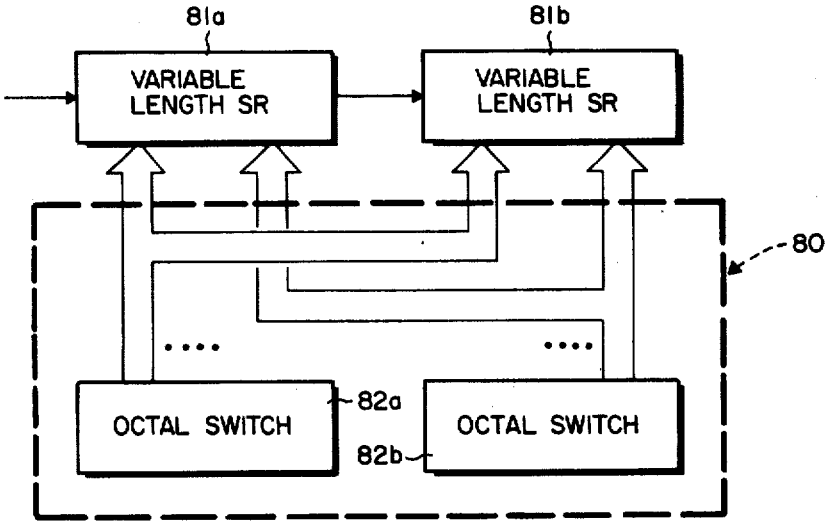
FIG. 7 is a logic block diagram of delay control means according to an embodiment of the present invention.

FIG. 7 shows a delay control apparatus 80 which may be used in conjunction with variable length shift registers 81A, 81B . . . to provide selective variability in the delay factor implemented by these shift registers. Variable length shift registers may be purchased off-the-shelf; Electron Arrays Part No. EA1202 variable length dynamic shift register is a typical example. That particular device is controlled by a six-bit input, whereby the logical "length" of the shift register can be varied selectively from 1 to 64 bits, depending on the control input.

Normally, a plurality of these variable length shift registers in series will constitute any one of the delay means 60A or 60B shown in FIG. 3. The number of these devices in the series is determined by the word length of the signal being scrambled or unscrambled and by the required flexibility in the delay factor — a shorter bit length in each word and/or less required flexibility would indicate a lesser number of variable shift registers in each series.

The control input to the shift registers is provided by a pair of conventional octal switches 82A, 82B, each one provided three of the six control bits to each of the shift registers.

Figure 8:
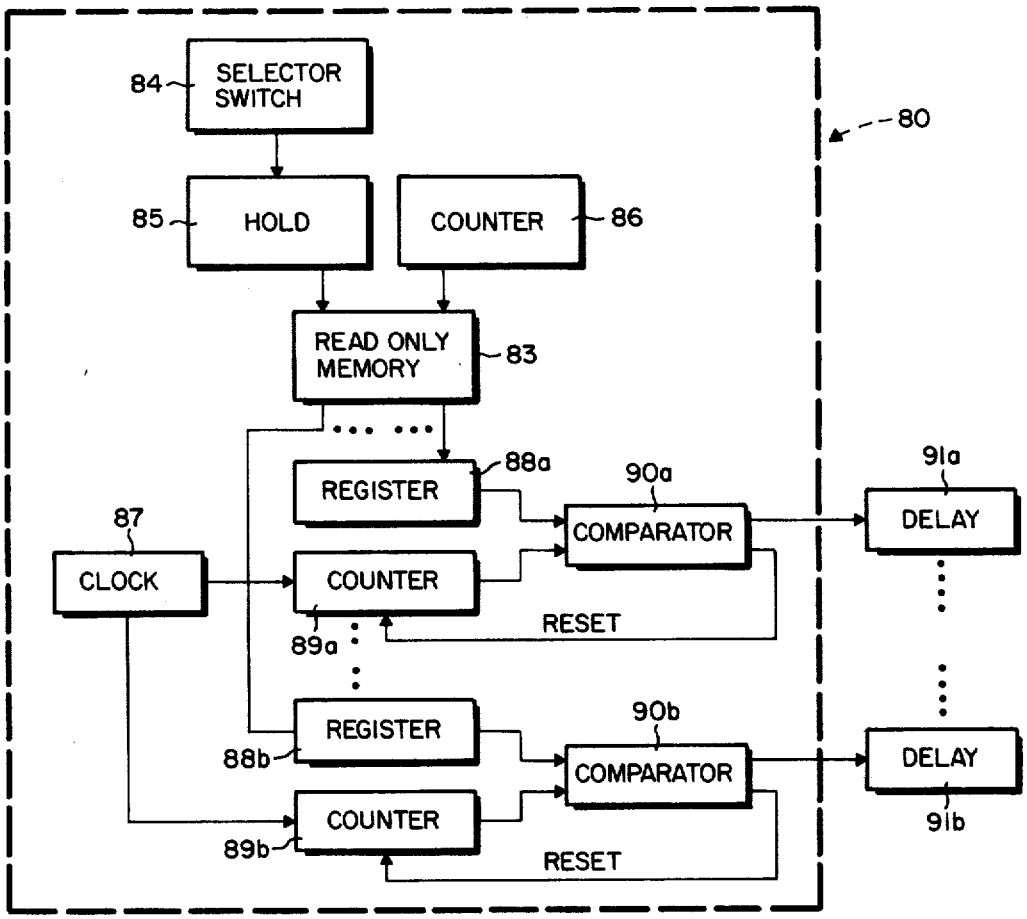
FIG. 8 is a logic block diagram of delay control means according to another embodiment of the present invention.

FIG. 8 shows another means by which, a variable delay may be implemented. In this means, the shifting frequency of the delay means is varied while the number of units of delay is constant, in distinction to the variable delay means just described, in which the shifting rate is constant while the apparent length of each register is variable.

The underlying principle in the apparatus shown in FIG. 8 involves selective frequency division of a fixed clocking rate, resulting in a selective clock rate input to the individual delay means.

The read only memory 83 contains a sequence of number series. The number of series in the sequence is the number of individual delay "schemes" which can be implemented by that read only memory, which may constitute a plug-in module. The number of individual numbers in each series is equal to the number of delay elements 91A, 91B, etc., whose delay factors are variable, the position of a given number within each series corresponding to a particular delay element. Each particular number is the factor by which the pulse frequency rate of the clock 87 is to be divided.

Accordingly, a selected number is inputted into the register 88A. The clock 87, outputs a series of pulses of fixed frequency which are counted by the counter 89A. The instantaneous count and the number in the register are compared by means of the comparator 90A. When the count reaches the number in the register, the comparator outputs a pulse to the delay element 91A and the counter is reset to zero.

In a similar manner, the register 88B, counter 89B and the comparator 90B frequency divide the clock pulses for input to the delay means 91B.

Any number of these combinations of register, counter and comparator may be utilized, the number again depending on the number of variable delay means in the total scrambler (or descrambler) apparatus.

The particular delay scheme to be implemented is selected (in coded fashion, if desired) by manipulation of the selector switch 84, which inputs an identifier to the holding register 85. A counter 86 appropriately cycles the read only memory 83.

In any embodiment involving variable delay, it is, of course, critical that at a given time, the identical delay factor be implemented in the descrambling delay module as in the complementary scrambling delay module.

Accordingly, in the embodiment shown in FIG. 8, the read only memory 83 and the selector switch 86 must be adapted to implement this by, for example, providing identical read only memory and selector switch devices in the descrambler as in the scrambler, or by arranging the contents of these elements such that a given selector switch code implements the same delay factor(s) whether this code is selected in the scrambler or the descrambler device.

E. Frequency Inversion Means

Figure 9:
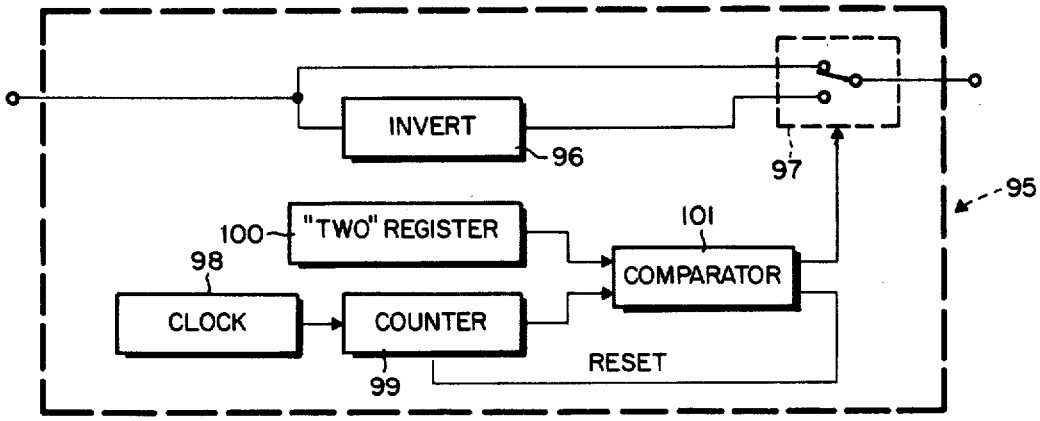
FIG. 9 is a logic block diagram of frequency inversion means.

FIG. 9 shows means by which frequency inversion may be selectively introduced to provide additional complexity in the delay module transfer function.

In digital or sampled analog embodiments of the present invention, frequency inversion is most easily implemented by changing the sign of alternate bits in the signal whose frequency is to be inverted, i.e., the sign of all "even-numbered" samples will remain unchanged while the "odd-numbered" samples will be multiplied by minus one, or vice versa.

FIG. 9 shows an apparatus for accomplishing this. Here, an inverter 96 is utilized to change the sign of any input thereto, a switch 97 determining which samples are to be inverted and which are to have their unchanged. The switch is operated by means of a pulse output from the comparator 101, which is generated in response to alternate pulses of the clock 98. This clock is either synchronized with or is the same clock as cycles the other components in the overall apparatus, such that each pulse of the clock represents a one-sample shift in the data signal. A counter 99 counts the clock pulses, and this count is compared by the comparator with binary two, which is inputted from a two register 100. The counter is reset each time the comparator outputs a pulse, i.e., in response to every other pulse of the clock.

F. Frequency Transulation

The frequency translation apparatus 105 shown in FIG. 3, can be any appropriate apparatus to accomplish frequency translation, for example, with conventional single-sideband techniques. The preferred procedure is to represent the output signal from the summer 66 as a complex quantity and perform a complex multiplication which produces the frequency translation.

Following the procedure set forth by R. W. Lucky, J. Satz and E. F. Weldon Jr., on pages 170–174 of *Principles of Data Communication*, published by McGraw Hill, New York City 1968, the first step is to obtain the quadrature component of the signal by performing the Hilbert transform. The Hilbert transform in effect, provides a wide-band 90° phase shift with unity gain. This can be accomplished using either digital or analog techniques, as shown by Ira M. Langenthal and Sankoran Gowrinathan in "Advanced Digital Processing Techniques" Rome Air Development Center Report RADC-TR-70-75, May 1970; and Sidney Darlington in "On Signal-Sideband Modulators", IEEE Transactions on Circuit Theory pages 409–414, August 1970.

The resulting quadrature signal component at the Hilbert transform output and the original (in phase) signal component (suitably delayed to match the delay implicit in the Hilbert transform) are multiplied by $\sin(\omega_o t_1)$ and $\cos(\omega_o t_1)$ respectively, 107 $_o$ being the selected transformation frequency. When the resulting products are summed (or differenced) all of the signal frequencies are shifted down (or up) by $\omega_o$.

The foregoing procedure is well-known in the telecommunications art and may be readily implemented by ordinary practitioners, using conventional digital or analog techniques.

G. Complete Single Delay Module Scrambler/Descrambler Transceiver Unit

Figure 10:
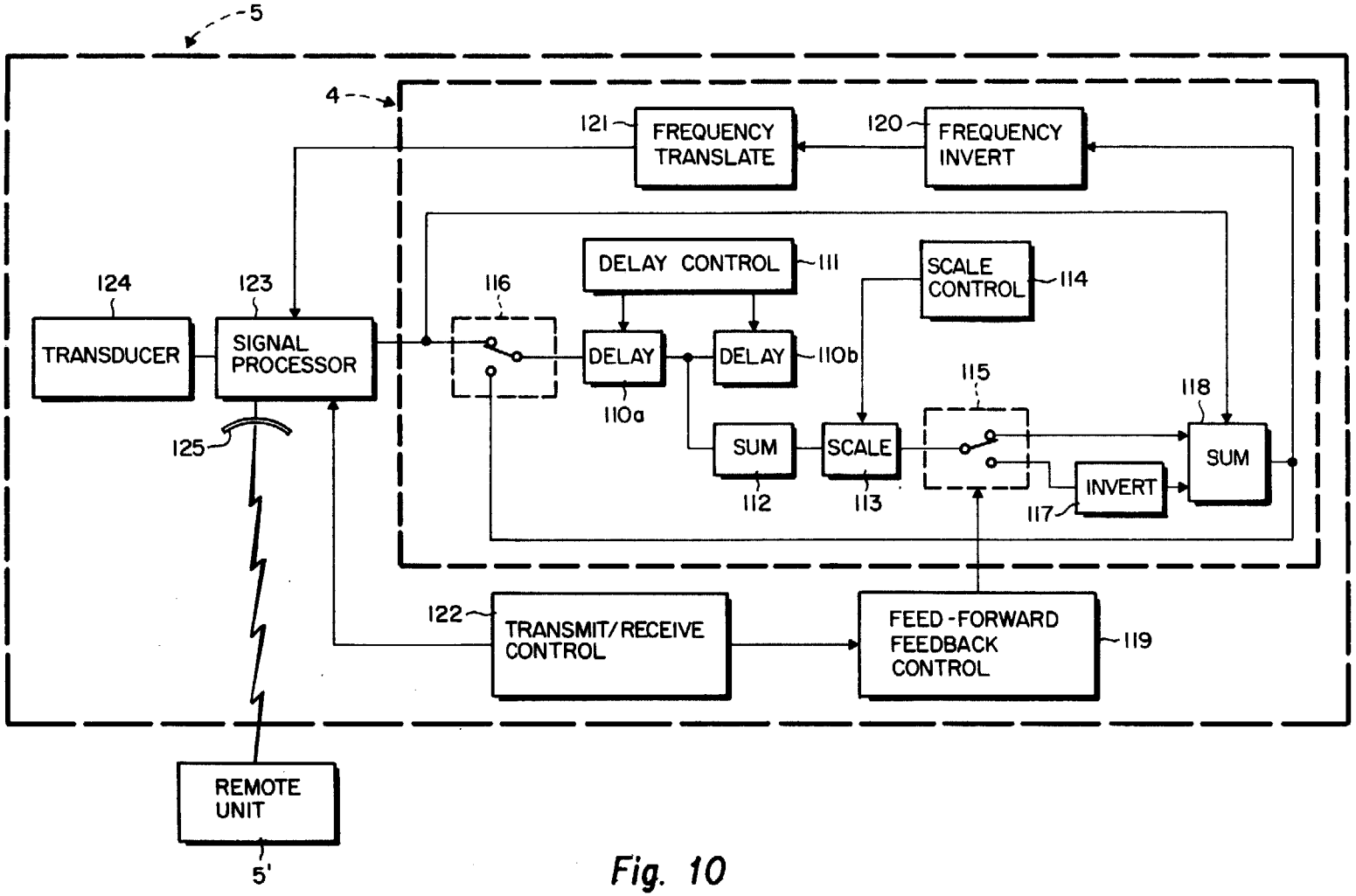
FIG. 10 is a logic block diagram of a complete one-mode transmit/receive apparatus.

FIG. 10 shows a complete scrambler/descrambler unit 5 incorporating a single delay module 4. This delay module is similar to the complex delay module 3 shown in FIG. 3, except that the feed-forward/feed-back control 119 in a present module is not an integral part of the delay module, itself, for reasons which will become apparent in the succeeding discussion of multiple-module units.

It is to be understood, however, that any of the delay modules hereinabove described can be incorporated in a complete scrambler/descrambler unit, and any or all of the transfer function improvement features, such as the frequency translation, frequency inversion, delay control and/or scale control can be eliminated as desired.

Referring again to FIG. 10, the delay module 4 incorporates a pair of delay units 110A, 110B whose delay factor is governed by a delay control 111. The delay units and delay control can be embodied as the variable length shift register-based apparatus shown in FIG. 7 or the frequency division apparatus shown in FIG. 8.

The output from each delay element is summed by means of the summer 112, and the resultant is scaled by means of the scaling device 113, whose instantaneous scale factor is implemented by the scale control device 114. The scaling device and scaling control device can be together implemented according to the apparatus shown in FIG. 4, FIG. 5 or FIG. 6.

The feed-forward/feed-back switches 115 and 116, both controlled by the feed-forward/feed-back control 119, determine whether the delay module is in a positive (feed-forward) or inverse (feed-back) mode as hereinabove described. The second switch 115 determines whether or not the sign of its input will be changed by the inverter 117.

The output from the summing device 118, may be fed through a frequency inverter 120, embodied similarly to the frequency inverter 95 previously described, whose output may be passed through a frequency translation device 121, constructed in accordance with the teachings and literature references hereinabove set forth.

The final output from the delay module 4 is fed into the signal processor 123. The signal processor comprises the electronic normally constituting a conventional transmitter/receiver of the type which might be found in any ordinary police squad car. In the TRANSMIT mode, it receives a signal from the transducer 124 (configured as a microphone), suitably amplifies, filters and, where necessary, analog-to-digital converts the signal and passes it to the delay module 4. It receives the scrambled output from the delay module, suitably amplifies, filters and otherwise processes the output signal for transmission through the antenna 125, for receipt by the remote unit 5', which is complementary to the transmitting device.

In the RECEIVE mode, the signal processor 123 receives the signal from the remote unit 5' by means of its antenna 125, suitably processes it for passage to the delay module 4 for descrambling, receives the descrambled output from the delay module and processes the output for passage to the transducer 124 (now configured as a loudspeaker) for playback.

The precise function and, therefore, the necessary circuitry inherent in the signal processor 123 will be readily understood by those skilled in the audio transmission art and need not be further described in detail.

The transducer 124 is a normal dual-function microphone/loudspeaker, such as found in conventional transceivers.

The mode of the complete unit 5 is determined by the transmit/receive control 122, which performs several functions. The device itself will typically comprise a simple, thumb-operated switch, whereby the operator selects between the transmit and receive modes. The device causes the transducer 124 to operate as a microphone (transmit) or loudspeaker (receive). It also causes the signal processor 123 to receive the signal from the antenna 125, process it and send it to the transducer (RECEIVE mode) or receive the signal from the transducer, process it and transmit it from the antenna (TRANSMIT mode). Finally, it causes the feed-forward/feed-back control 119 (normally a switch or relay) to appropriately set the position of the two control switches 115, 116 in the delay module 4.

In operation, the operator selects the TRANSMIT mode in the transmit receive control 122, speaks into the transducer 124 (now configured as a microphone) and broadcasts a scrambler message through the antenna 125. Selecting the RECEIVE mode he receives a scrambled message through the antenna 125 and hears the unscrambled version through the transducer (now configured as a loudspeaker).

H. Complete Multiple Delay Module Transceiver Units

Figure 11:
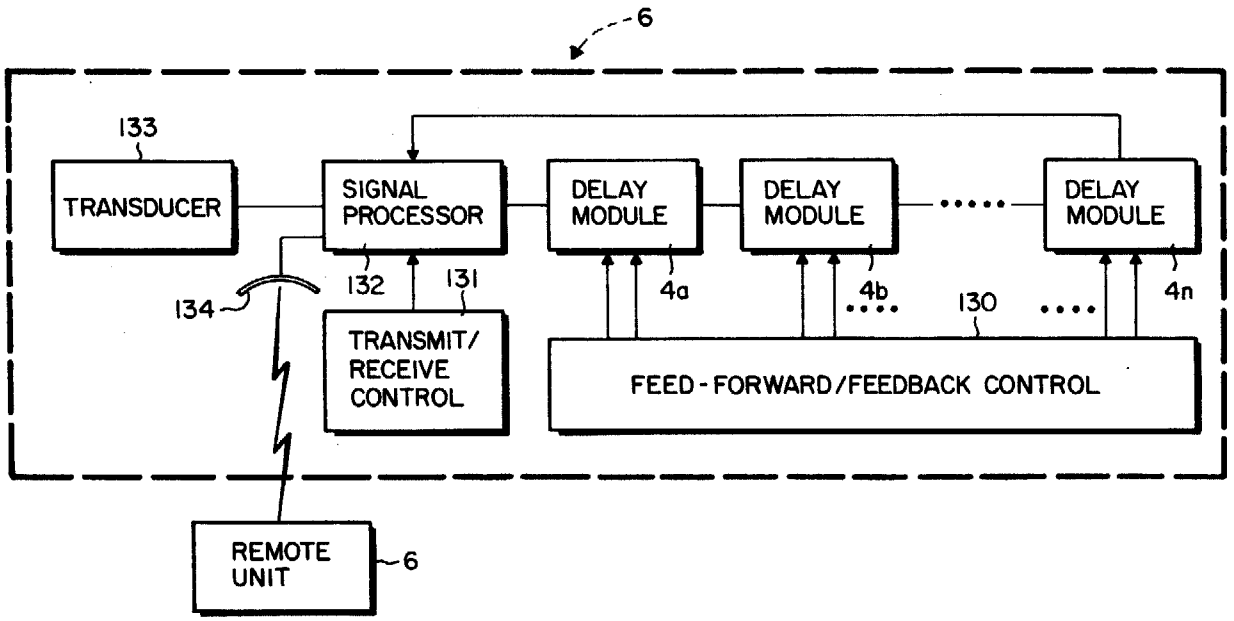
FIG. 11 is a logic block diagram of a complete multi-module transmit/receive apparatus.

FIG. 11 shows a complete transceiver similar to that shown in FIG. 10, except that the present unit employs a plurality of delay modules $4_A$, $4_B$. . . $4_N$, with a single feed-forward/feed-back control 130 to govern the instantaneous mode of them all.

The various scrambling operations hereinabove described are linear in nature, i.e., they may be combined in any order in the scrambler provided, of course, that in the descrambler, exactly complementary delay modules are provided. Accordingly, each of the delay modules in the complete unit 6, may be different. For example in the TRANSMIT mode, some of the delay modules may be in the feed-forward mode, while others may be in the feed-back mode, provided that in the RECEIVE mode, the modes of the individual delay modules are each reversed. Furthermore, each individual delay module in the series may constitute any one of the hereinabove described delay modules, with any or all of the transfer function improvement features, such as delay factor control, etc., which have been described.

In other respects, the present transceiver unit 6 corresponds exactly to the transceiver unit 5, shown in FIG. 10, and all the corresponding elements may be similarly embodied.

I. Transceiver Unit Synchronzation

In order that each of a pair of scrambler/descrambler units be able to descramble each others transmitted messages, each of the units must be complementary to the other, at least during transmission and receipt of messages. This requires that, at least during that time, 1. Each unit must incorporate the same number of delay modules;
2. Corresponding pairs of delay modules must be in complementary modes (i.e., one must be in a feed-forward mode, if the other is in a feed-back mode);
3. The delay factor(s) in corresponding pairs of modules must be equal;
4. The scaling factor(s) in corresponding pairs of modules must be equal;
5. Frequency inversion must be implemented in both or neither of the units; and
6. If one unit incorporates an $\omega_o$ frequency translation, the other must incorporate a $-\omega_o$ translation.
7. If any of the above parameters are changed during the message, both units must change at the same time (assuming no delay between transmission and reception).

There are many ways to insure such synchronization, of which the following are typical.

In the first example, where the transceiver unit is the unit 6, shown in FIG. 11, the transceivers of all users are adapted to by-pass the scrambler/descrambler function, unless the latter is specifically implemented by insertion of a coded plug-in module. Insertion activates a switch, which, in turn, activates the scramble/descrambler activity. This module incorporates a set of five thumb-activated selector switches, each of which governs one of the following:

1. Whether frequency inversion will be implemented;
2. The frequency translation to be implemented (0, 20 hz, −20 hz, 40 hz, etc.);
3. The delay factor or delay factor scheme (in multi-module units) to be implemented;
4. The scale factor or scale factor scheme (in multi-module units) to be implemented; and
5. Which feed-forward/feed-back mode (for each delay module, in multi-module units) represents TRANSMIT — RECEIVE is merely the complementary mode (or set of modes).

The five switches each incorporate a discrete number of lettered settings, perhaps 10 or 20, each of which is coded internally to represent a particular identifier for the particular function controlled.

Each plug-in module contains a unique set of read only memories (such as read only memory 74, for scale factor control, and 83, for delay factor control) and other logic circuitry, so that a particular combination of switch settings will have a unique net effect on the transceiver, depending on which plug-in module is utilized.

All plug-in modules will have one switch setting combination which will implement the same control functions in all transceivers, in order to permit communication between all authorized users. In addition, each plug-in module belonging to each identified group of users will have an additional setting to permit communication between all members of that group.

In the second example, where the parameters (e.g. the delays, scale factors, frequency inversion, frequency translation, etc.) are changed during the transmission of a message, it is necessary to establish more exacting synchronization between the transmitter and receiver, so that any change in parameters is effected essentially simultaneously at both transmitter and receiver.

Since the interval between each change in parameters can be performed in both transmitter and receiver according to a program stored in a control read only memory (see Sections C and D above) all that is required is that the transmitter inform the receiver when the first change is parameters is to occur. This is easily accomplished using synchronization procedures well known in the telecommunications art.

For example, at the beginning of each message the transmitter can send a short sequence of data using a convenient modulation technique (e.g. frequency shift keying, phase shift keying, amplitude modulation, etc.). At the receiver, the timing of the data symbols is extracted by means of a phaselock loop or other suitable means. The resulting timing information is used to synchronize the timing in the receiver governing the change in parameters.

The details of such a procedure are well known in the telecommunications art and described in detail in the Handbook by Telemetry and Remote Control, edited by Elliot L. Gruenberg, McGraw-Hill, New York, N.Y., 1967, pp 8-30 –8-43, and in Telecommunication System Engineering, by W. C. Lindsey, Prentice-Hall, Englewood Cliffs, N.J., 1973, Chapter 9, pp 418 –482.

Whatever the particular synchronization scheme, in use, the user originating the communication transmits an unscrambled instruction that a certain user or certain users, identified by user code(s) (telephone number(s), car number(s), badge number(s), etc.), insert his plug-in module and adjust the settings to a particular combination. Following this, the conversation may occur without undue fear that it will be understood by those not authorized to receive it.

I claim:

1. Signal transmission protection apparatus comprising:

a first module, comprising:

delay means to separate an electrical signal, input thereto, into a selected number of primary subsignals, each of said primary subsignals being substantially identical to said electrical signal, each of said primary subsignals further being temporally spaced from said electrical signal and from the remaining primary subsignals; and arithmetic means to change instantaneous values of said electrical signal by the sum of first fractional parts of the contemporaneous values of each of said primary subsignals, to generate an output from said first module;

transmission means to transmit a resultant signal, derived from said output from said first module, to a remote location;

receiver means, at said remote location, for receiving said resultant signal;

a second module, comprising;

delay means, to separate an electrical signal, introduced thereto, said introduced signal derived from said resultant signal, into a desired number of secondary subsignals, each of said secondary subsignals being substantially identical to said introduced signal, each of said secondary subsignals further being temporally spaced from said introduced signal and from the remaining primary subsignals, said desired number being identical to said selected number, and the temporal spacing between each of said secondary subsignals and said introduced signal being substantially identical to that between the corresponding ones of said primary subsignals and said input signal; and second arithmetic means to change instantaneous values of said introduced signal by the sum of second fractional parts of the contemporaneous values of said secondary subsignals; wherein:

the arithmetic sign of the activity of said second arithmetic means is opposite to the arithmetic sign of the activity of said first arithmetic means, and said first fractional parts are equal to said corresponding second fractional parts; and the one of said two modules in which said arithmetic sign is negative further includes means to input said changed values into said delay means thereof.

2. Apparatus as recited in claim 1, wherein said arithmetic sign is negative in said first module.

3. Apparatus as recited in claim 1, wherein said arithmetic sign is negative in said second module.

4. Apparatus as recited in claim 1, wherein said arithmetic sign in each of said modules is fixed.

5. Apparatus as recited in claim 1, wherein said arithmetic sign in each of said modules is selectively variable.

6. Apparatus as recited in claim 1, wherein at least one of said delay means comprises a plurality of delay elements.

7. Apparatus as recited in claim 1, wherein each of said delay means comprises a single delay element.

8. Apparatus as recited in claim 1, wherein said first fractional parts and said second fractional parts comprise fixed factors.

9. Apparatus as recited in claim 1, wherein said first fractional parts and said second fractional parts comprise selectively variable factors.

10. Apparatus as recited in claim 1, wherein said temporal spacings in said first and said second delay means are fixed.

11. Apparatus as recited in claim 1, wherein said temporal spacings in said first and said second delay means are at least in part selectively variable.

12. Apparatus as recited in claim 1, further including first frequency translation means operably associated with said first module and second frequency translation means operably associated with said second module.

13. Apparatus as recited in claim 1, further including first frequency inversion means operably associated with said first module and second frequency inversion means operably associated with said second module.

14. Apparatus as recited in claim 1, further including:

an even number of additional modules, each of said additional modules comprising:

delay means to separate an electrical signal, input thereto, into a selected number of primary subsignals, each of said primary subsignals being substantially identical to said electrical signal, each of said primary subsignals further being temporally spaced from said electrical signal and from the remaining primary subsignals; and arithmetic means to change instantaneous values of said electrical signal by the sum of fractional parts of the contemporaneous values of each said primary subsignals, to generate an output from said first module;

the first half of said number being in series with said first module, and the second half being in series with said second module, wherein, with respect to each complement pair, consisting of one of said modules in said first half and a corresponding module in said second half:

said selected numbers are equal;

said temporal spacings within the delay means of each are substantially identical;

said corresponding fractional parts are equal; and the arithmetic sign of the activity of the arithmetic means of one of said complement pair is opposite that of the other, the module in which the sign is negative further including means to input said changed value into the delay means thereof.

* * * * *